US005208948A

United States Patent [19]

Nirei

[11] Patent Number: 5,208,948

[45] Date of Patent: May 11, 1993

[54] APPARATUS FOR AND METHOD OF BINDING ELECTRIC CABLES

[75] Inventor: Shigenobu Nirei, Mitaka, Japan

[73] Assignee: Nirei Industry Co., Ltd., Tokyo, Japan

[21] Appl. No.: 789,871

[22] Filed: Nov. 12, 1991

[30] Foreign Application Priority Data

Nov. 27, 1990 [JP] Japan ..... 2-124767[U]

[51] Int. Cl.[5] ..... B65D 63/00

[52] U.S. Cl. ..... 24/16 PB; 100/30; 140/93 A

[58] Field of Search ..... 100/29, 30; 24/16 R, 24/16 PB; 140/93 A

[56] References Cited

U.S. PATENT DOCUMENTS

| | | | |
|---|---|---|---|
| 4,680,834 | 7/1987 | Andre et al. | 24/16 PB |
| 4,763,700 | 8/1988 | Hidaka et al. | 140/93.2 |
| 4,908,911 | 3/1990 | Bretti | 140/93 A |
| 5,088,395 | 2/1992 | Schlottke | 100/30 |

FOREIGN PATENT DOCUMENTS

| | | | |
|---|---|---|---|
| 2511240 | 9/1975 | Fed. Rep. of Germany | 24/16 PB |
| 8204030 | 11/1982 | Japan | 24/16 PB |
| 2-29286 | 8/1990 | Japan . | |

*Primary Examiner*—Philip R. Coe
*Assistant Examiner*—Randall E. Chin
*Attorney, Agent, or Firm*—Oliff & Berridge

[57] ABSTRACT

An apparatus for binding electric cables, etc. containing a series of prolonged binding bands wound round an object to be bound, like electric cables, etc., in a loop fashion, formed with a plurality of convex-like gears in a rack fashion on a surface of the binding band; a stopper having an opening portion through which the binding band is inserted with respective back faces overlapping; a pair of pawl members concurrently projected from opposing walls inside the opening portion, the pawl members engaged with the convex-like gears of the binding band; parallel ribs protrusively formed on both sides of an opening end of the opening portion of the stopper, the opening end facing toward the top, unattached end of the pawl member; and a space formed so that a cutter for cutting a protruding portion of the binding band may pass through between the ribs.

2 Claims, 5 Drawing Sheets

APPARATUS FOR AND METHOD OF BINDING ELECTRIC CABLES

BACKGROUND OF THE INVENTION

1. Field of the Invention

The present invention relates to an apparatus for binding electric cables etc., comprising a combination of a binding band formed with a plurality of convex-like gears in a rack fashion and a stopper provided with a member having a pair of pawls engageable with said convex-like gears.

2. Description of the Prior Art

The applicant of the present invention has proposed an apparatus for binding electric cables etc. of this sort, having a structure as shown in the specification filed by the Japanese Laid-Open Utility Model Publication No. 62-65954. In this specification, one end of a binding band is first inserted into an opening portion of a stopper and then wound round an object to be bound, like electric cables, etc., in a loop fashion and again inserted into the opening portion of the stopper in the reverse direction to engage a convex-like gear of the binding band with a pawl member positioned on the one side of the stopper. Thereafter, the root side of the binding band is tightened and secondly the convex-like gears thereof are engaged with the pawl member positioned on the other side of the stopper to bind the electric cables, etc. A useless portion of the binding band protruding from the stopper is cut off. In the following step of binding, a setting portion can be employed as a top end together with another, stopper. Accordingly, a series of binding bands can be efficiently employed and furthermore firm binding of the object is enable.

However, in the above-mentioned binding apparatus as shown in FIG. 1, when the useless portion of a binding band 1 protruding from the stopper is cut off, the thus-cut end face projects from an opening end of the stopper 2 and moreover an angle portion of a projecting end 15 of the binding band 1 is formed into an acute shape since the cutting is performed by means of a sharp-edged tool of a cutter. Accordingly, if cords used inside automobiles, office machines or the like are bound by the above-mentioned binding apparatus in order to be positioned inside, when operators reach into the automobiles, office machines or the like on the job of maintenance operations etc., the operators may work their hands on the projecting end 15 of the binding band protruding from the stopper. This is, of course, dangerous, and blood from an operator's injury stains finished components (for instance, seats of automobiles) and blood stains cause reduced merchandise value.

SUMMARY OF THE INVENTION

The present invention solves the above-mentioned conventional drawbacks. It is an object of the present invention to provide an apparatus for and method of binding electric cables, etc. which, in particular, is not dangerous, and therefore doe not injure operators, preventing stained merchandise or the like.

In order to achieve the above-mentioned objects, the apparatus for binding electric cables, etc. according to the present invention comprises a combination of a series of prolonged binding band for binding by winding the band round an object to be bound, like electric cables, etc. in a loop fashion, formed with a plurality of convex-like gears in a rack fashion on a surface of the binding band, and a stopper having an opening portion through which the binding band is inserted in a state with respective back faces thereof being overlapped, and concurrently projected a pair of pawl members in a trapezoid shape which are engaged with said convex-like gears of the binding band respectively inserted through said opening portion from one opposing wall inside the opening portion. The apparatus for binding electric cables, etc. is featured in that parallel ribs are protrusively formed on both sides of an opening end of the opening portion of said stopper which is facing toward the top end side of the pawl member, and in that a space is formed so that a cutter for cutting a protruding portion of said binding band may pass through between the ribs arranged on both the sides.

With the above-mentioned arrangement, the top end of the binding band is penetrated into the opening portion of the stopper and drawn out to wind the binding band round the object to be bound, like electric cables, etc. in a loop fashion. Then, the above-mentioned one end is again inserted into the opening portion of the stopper in the reverse direction to pass the binding band through the opening portion in a state with the respective back faces being overlapped, so that the convex-like gears may be engaged with pawl portions of one pawl member of the stopper. Thereafter, the root side of the binding band is tightened to bind by engaging the convex-like gears with the pawl portions of the other pawl member of the stopper.

The useless portion of the binding band is cut out by passing and moving the cutter through the space of the ribs on both the sides, provided at the opening end of the stopper.

When the useless portion of the binding band is cut out by passing the cutter through between the ribs of the stopper, a cutting surface of the binding portion is positioned at least lower than a protruding end surface of the ribs. Accordingly, even when the operators move their hands along the protruding end surface of the ribs of the stopper on a certain occasion, the cutting surface of the binding band does not strike on the surface of their hands, thereby their hands being prevented from being wounded. As a result, the apparatus according to the present invention is entirely safe and in addition it is beforehand avoidable to make the merchandise value lower by staining the merchandises due to the operators' bleeding.

These and other objects, features and advantages of the present invention will be more apparent from the following description of a preferred embodiment, taken in conjunction with the accompanying drawings.

DETAILED DESCRIPTION OF THE EMBODIMENTS

Figure 1:
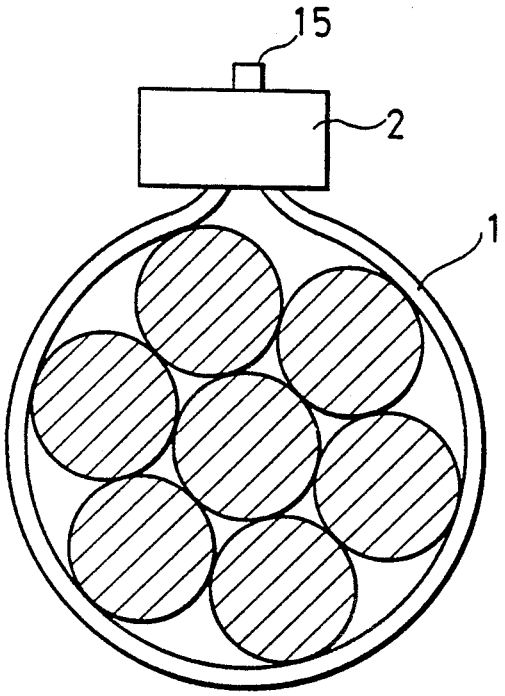
FIG. 1 is an illustration showing a state of binding electric cables in a conventional binding apparatus.

Hereinafter, preferred embodiments according to the present invention will be described with reference to the accompanying drawings.

In the figures, a reference character A shows a binding apparatus. The binding apparatus A comprises a combination of a binding band 1 made of synthetic resins and a stopper for use in binding electric cables or the like.

Figure 3:
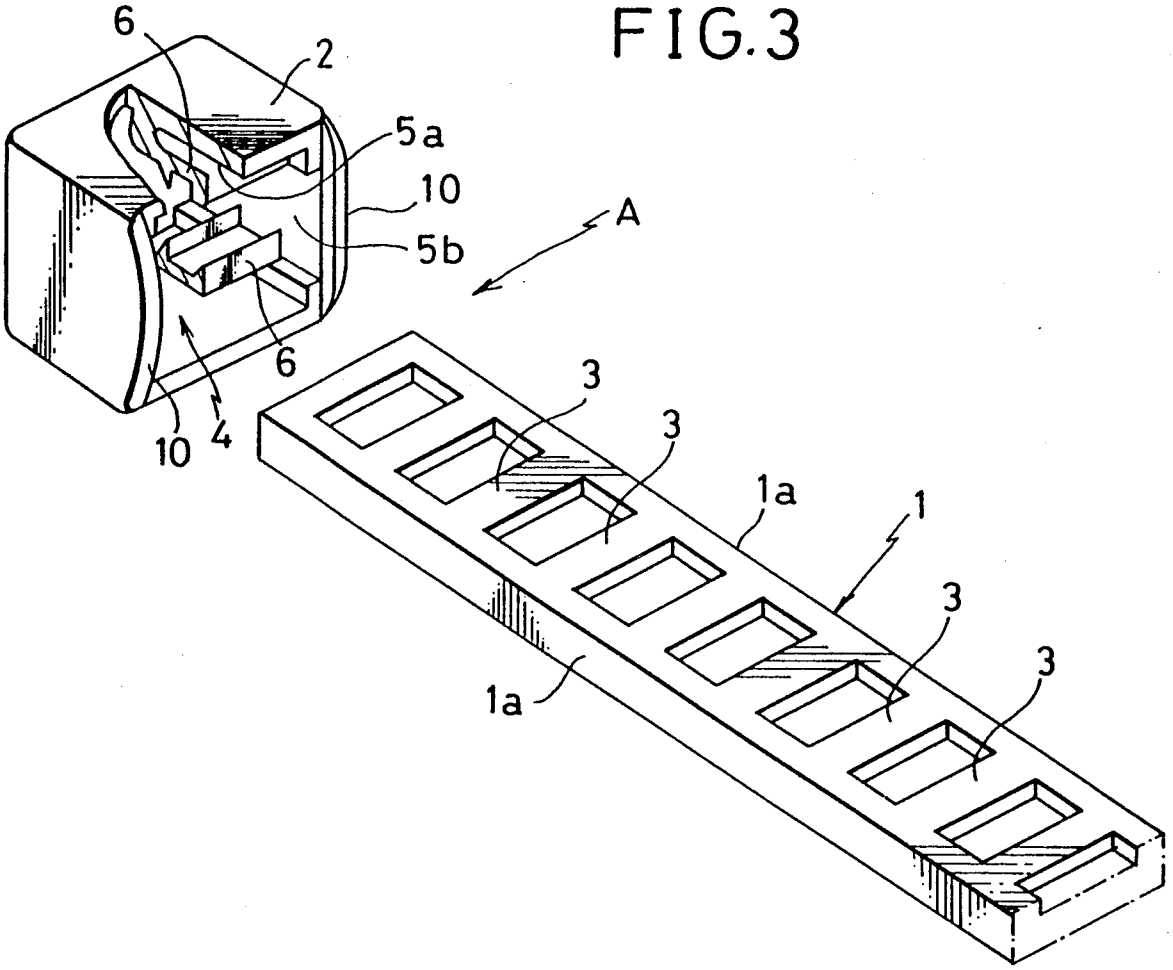
FIG. 3 is a perspective view of a binding band and a stopper of the binding apparatus, which is a preferred embodiment according to the present invention.

The binding band 1 is used for binding by winding it around an object to be bound, like electric cables, etc. in a fashion. As shown in FIG. 3, the binding band 1 comprises a prolonged member formed with a plurality of convex-like gears 3, 3 . . . in a rack fashion on a surface thereof.

Figure 2:
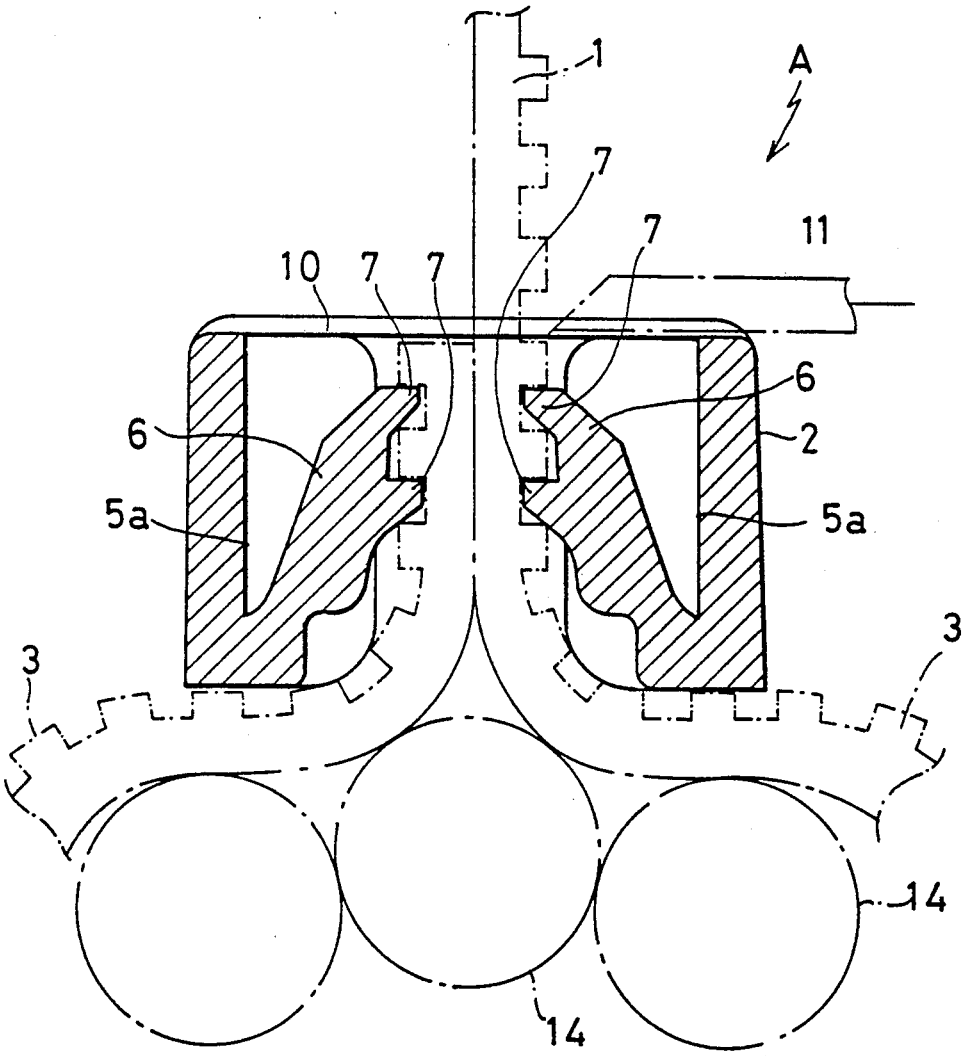
FIG. 2 is a cross-sectional view of a main portion of an apparatus for binding electric cables, which is a preferred embodiment according to the present invention.
Figure 4:
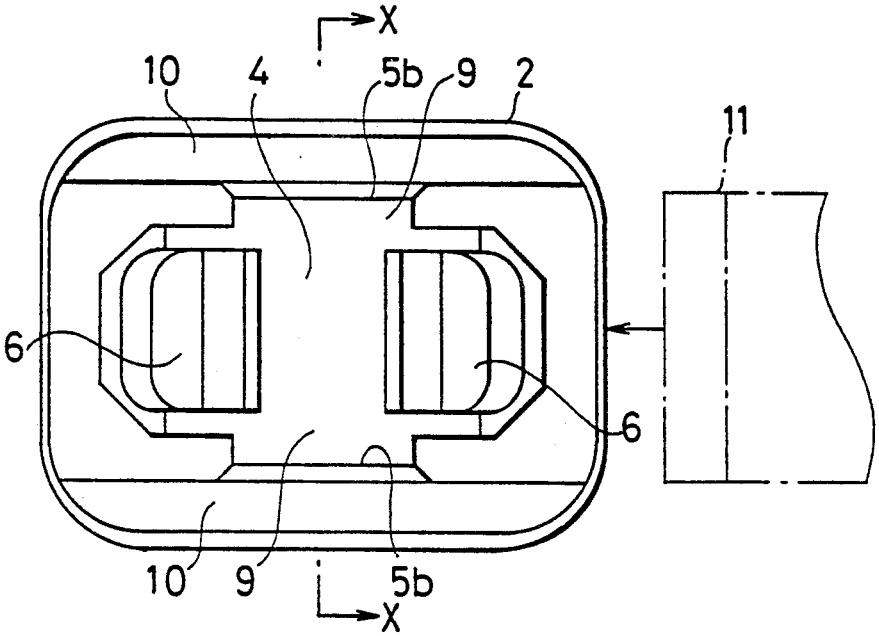
FIG. 4 is a plan view of the stopper as shown in FIG. 3.
Figure 5:
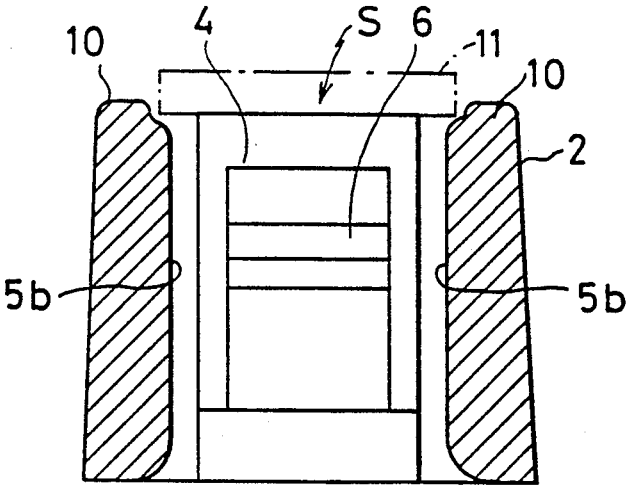
FIG. 5 is a cross-sectional view, taken in the line X—X of FIG. 4.
Figure 6A:
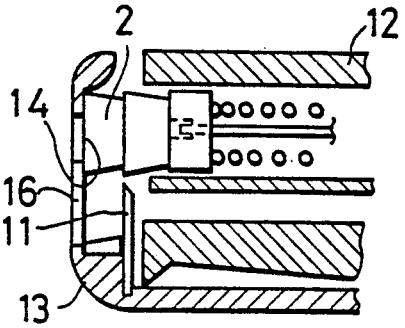
FIG. 6(*a*) to 6(*e*) are illustrations of binding aspects based on the binding apparatus as shown in FIG. 2.
Figure 6B:
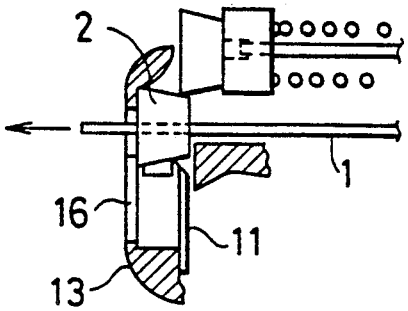
Figure 6C:
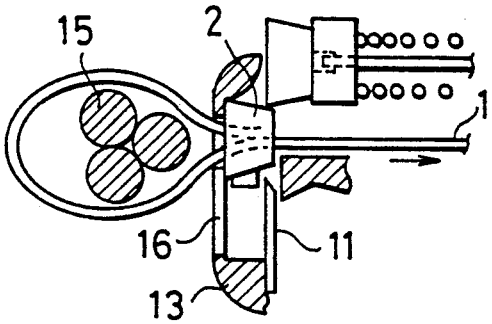
Figure 6D:
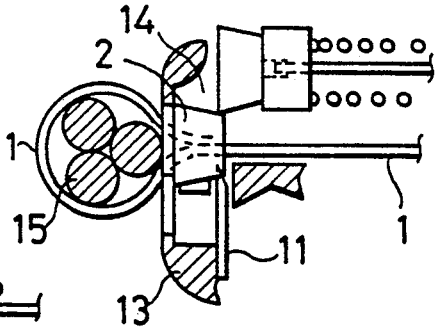
Figure 6E:
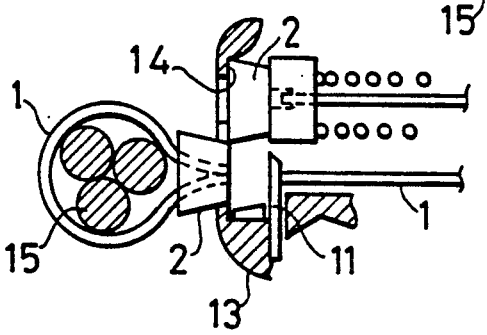

The stopper 2 has, as shown in. FIGS. 4 and 5, an opening portion 4 with a size large enough to insert the binding band 1 into the opening portion 4 in a state with respective back surfaces of the binding band 1 being overlapped. As shown in FIG. 2, a pair of pawl members 6, 6 in the stopper 2 project in a trapezoidal shape to engage the plurality of convex-like gears 3, 3 . . . of the binding band 1 by respectively intruding into said opening portion 4 from one of the opposing inside walls 5*a*, 5*a* of portion 4.

As shown in FIG. 2, the pawl members 6, 6 are flexibly supported at a lower portion of the opposing walls 5*a*, 5*a* of the stopper 2. On the inner surface of each of the pawl members 6, 2 pieces of pawl portions 7, 7 are formed in opposition to each other so as to respectively engage the convex-like gears 3, 3 of said binding band 1. An aperture between the top ends of the pawl members 6, 6 is formed wider than a thickness of the binding band 1. The opposing inner faces on the base side of the pawl member 6 are formed so as not to disturb the interposition of the binding band 1 inserted into the inside of the opening portion 4 so that the binding band 1 may readily be inserted.

As shown in FIG. 4, the opposing walls 5*a*, 5*a* of said opening portion 4 are adjacent to the other opposing inside walls 5*b*, 5*b*, which are formed with guide chamfers 9, 9 for guiding both side edges 1*a*, 1*a* of the binding band 1 inserted respectively into the inside of said opening portion 4 to insert the binding band 1 so as to put the overlapped face of the binding band 1 on a central axis of said opening portion 4.

As shown in FIG. 5, in the opening portion 4 of said stopper 2, parallel ribs 10, 10 are protrusively formed on both sides of an opening end facing to the top end side of said pawl members 6, 6, namely on an upper end portion of the opposing walls 5*b*, 5*b*. A space S is formed between the ribs 10, 10 of both the sides so that a cutter 11 for cutting the useless portion of said binding band 1 may sufficiently pass. Said space S is formed so that the top end of the pawl members 6, 6 may not come into the space S.

An aspect of using the binding apparatus A with the above-mentioned arrangement is described below. As shown in FIG. 6(*a*), a head portion 13 is provided in the backward and forward moving manner at the front end of a tool body 12 of the binding tool. The tool body 12 is loaded in a line with the stoppers 2 to which a force is applied in the forward direction. By moving the head portion 13 in the one direction, the forefront stopper 2 is jumped into a receiving portion 14 of the head portion 13. Subsequently, the top end of the binding band 1 set in the tool body 12 is inserted into the opening portion 4 of the stopper 2 inside the head portion 13 (FIG. 6(*b*)). The binding band 1 is then wound around an object 15 to be bound, like electric cables, etc. in a loop fashion, and the one end of the binding band 1 is again inserted into the opening portion 4 of the stopper 2 in the reverse direction to engage the convex-like gears 3 with the pawl portions 7, 7 of the one pawl member 6 of the stopper 2 (FIG. 6(*c*)). Thereafter, by tightening the root side of the binding band 1 and engaging the convex-like gears 3 with the pawl portions 7, 7 of the other pawl member 6 of the stopper 2, the object is finally bound (FIG. 6(*d*)).

The useless portion of the binding band 1, namely a portion protruding from the stopper 2, is cut out by the cutter 11 provided in the head portion 13 by moving the head portion 13 again, and thereafter the stopper 2 drifts away from a hole 16 of the head portion 13 (FIG. 6(*e*)). At the same time, the succeeding stopper 2 is jumped into the receiving portion 14 of the head portion 13 to prepare for a subsequent binding.

By the way, as shown in FIGS. 2, 4 and 5, since said cutter 11 passes through the space S between the ribs 10, 10 of the stopper 2, the cutter 11 does not cut anything other than the binding band 1 when passing through the space S.

As described above, the cutter 11 passes through between the ribs 10, 10 of the stopper and therefor when the useless portion of the binding band 1 is cut out, the cutting surface of the binding portion is positioned at least lower than the protruding end surface of the ribs 10, 10. Accordingly, even when the operators move their hands along the protruding end surface of the ribs 10, 10 of the stopper 2 later on, the cutting surface of the binding band 1 does not strike on the surface of the operators' hands, thereby preventing their hands from becoming injured. As a result, the binding apparatus according to the present invention is entirely safe, and merchandise devaluation due to the operators' bleeding is avoided.

Incidentally, the ribs of the stopper may be formed on both the sides of the opening end on the side of the opposing walls 5*a*, 5*a* formed with the pawl members, so that the cutter may pass through between the ribs with the above arrangement.

Various modifications will become possible for those skilled in the art after receiving the teachings of the present disclosure without departing from the scope thereof.

What is claimed is:

1. A binding article for binding an object to be bound, comprising:

(a) an elongated binding band for binding the object to be bound by winding the band around the object in a loop-like fashion and formed with a plurality of convex-like gears in a rack-like fashion on a surface of the binding band;

(b) a stopper having:

i) an opening portion through which the binding band is inserted with respective back faces of the binding band overlapping, said binding band having a portion protruding from the stopper;

ii) an inside wall of the opening portion having two opposing portions;

iii) an opening end of the opening portion; and iv) a pair of pawl members, each pawl member being concurrently projected from one of the opposing portions of the inside wall of the opening portion, each pawl member engaging with said convex-like gears of the binding band, and each pawl member having a top, unattached end; and (c) parallel ribs protrusively formed on both sides of the opening end of the opening portion of said stopper, said opening end facing the top, unattached end of the pawl members and a space being formed between the parallel ribs so that a cutter for cutting said protruding portion of said binding band may pass between the ribs.

2. The binding article of claim 1, wherein the protruding portion of the binding band is cut by passing the cutter between the ribs of the stopper such that the cut binding band has a cut end that is positioned at least lower than a protruding end surface of the ribs.

* * * * *